United States Patent [19]

Meyer

[11] Patent Number: 5,063,714

[45] Date of Patent: Nov. 12, 1991

[54] GRINDING WHEEL FOR DEEP GRINDING

[75] Inventor: Hans-Robert Meyer, Hamburg, Fed. Rep. of Germany

[73] Assignee: Firma Ernst Winter & Sohn (GmbH & Co.), Hamburg, Fed. Rep. of Germany

[21] Appl. No.: 334,288

[22] Filed: Apr. 4, 1989

[30] Foreign Application Priority Data

Apr. 7, 1988 [DE] Fed. Rep. of Germany ..... 3811584

[51] Int. Cl.[5] ..... B24D 5/00

[52] U.S. Cl. ..... 51/209 R; 51/207; 51/206 R

[58] Field of Search ..... 51/165.83, 165.93, 206 R, 51/207, 209 R, 204, 293

[56] References Cited

U.S. PATENT DOCUMENTS

| | | | |
|---|---|---|---|
| 3,067,551 | 12/1962 | Maginnis | 51/207 |
| 3,121,981 | 2/1964 | Hurst | 51/207 |
| 3,691,707 | 9/1972 | Von Arx et al. | 51/206 R |
| 4,180,048 | 12/1979 | Regan | 51/206 R |
| 4,338,748 | 7/1982 | Elbel | 51/206 R |
| 4,407,263 | 10/1983 | Murata | 51/206 R |
| 4,456,516 | 6/1984 | Schaffner | 51/165.83 |
| 4,561,218 | 12/1985 | Dzewaltowski et al. | 51/165.93 |
| 4,671,021 | 6/1987 | Takahashi et al. | 51/293 |
| 4,757,645 | 7/1988 | Ozer et al. | 51/206 R |
| 4,805,586 | 2/1989 | Borse | 51/204 |

*Primary Examiner*—Maurina Rachuba
*Attorney, Agent, or Firm*—Michael J. Striker

[57] ABSTRACT

A grinding wheel for deep grinding comprises a main body, and a diamond coating on the main body, the diamond coating including a first coating part with fine grain diamonds and a second coating part with diamonds of greater size, the second coating being composed of a plurality of diamond grains which are arranged in one layer as considered in a direction parallel to a feeding direction of the diamond wheel and in a plurality of layers as considered in a direction perpendicular to the feeding direction, the diamond grains of the second coating part being arranged in direct contact with one another and held in a galvanically deposited binder.

11 Claims, 1 Drawing Sheet

FIG. 1
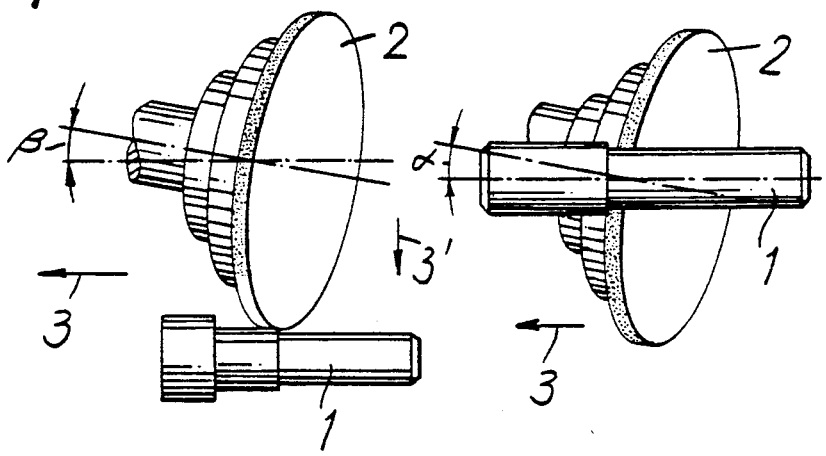
FIG. 2
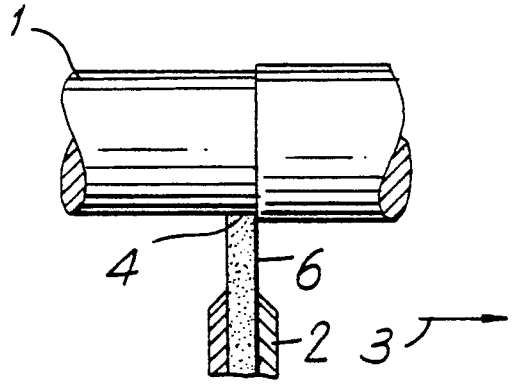
FIG. 3
PRIOR ART
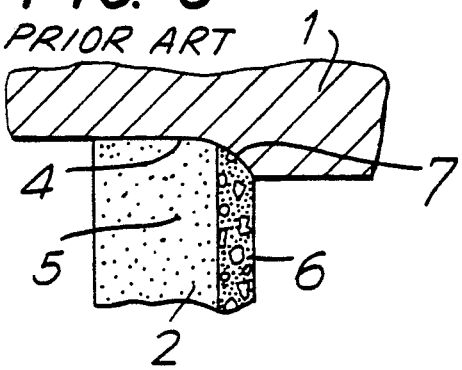
FIG. 4
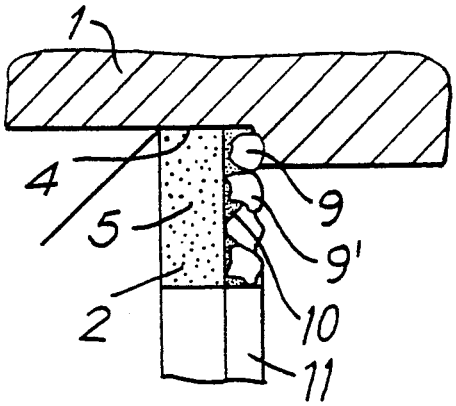
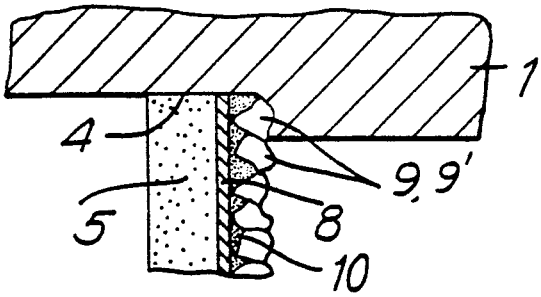
FIG. 5

GRINDING WHEEL FOR DEEP GRINDING

BACKGROUND OF THE INVENTION

The present invention relates to a grinding wheel, particularly for deep grinding. More particularly, it relates to a grinding wheel which has a two-part grinding coating with one part composed of fine grain diamonds and another part formed on one side and containing coarse grain diamonds.

During deep grinding of a workpiece with a peripheral grinding wheel or with a cup grinding wheel with diamonds or cubic crystalline boron nitride, in the course of the service life of the grinding wheels a so-called roof profile is formed on the active surface of the grinding wheel. The form of the roof profile depends on the width of the grinding coating and the height of the adjustment of the grinding wheel. The main work of material removal is performed by a part of the grinding surface of the grinding wheel which is first as considered in the feeding direction, while the subsequent part determines the quality of the surface of the workpiece. Since different surface portions of the grinding wheel perform different tasks, it is known to design the part of the grinding surface differently with consideration of the different loads and more particularly to use in this portion different sizes of diamond grains as well as different concentrations of diamonds.

A known peripheral grinding wheel is provided on its peripheral surface and a known cup grinding wheel is provided on its end surface with fine grain diamonds which are held in a binder. The binder can be composed of for example of a phenol resin and copper. In the region of the grinding wheel which is subjected to higher loads the diamonds grains are arranged with greater classification, while in the region which determines the quality of the surface of workpiece diamonds of smaller specification are embedded. The regions have the binders of the same type, and the diamond grains are stochastically distributed in the binder in correspondence with respective volume fraction.

Conventionally the different coating zones are selected so that the grinding wheel with the coating part with fine grain specification can achieve the desired surface quality, while the coating part with the greater diamond grain specification does not break under the action of the loads at the predetermined material removal volume per time unit, and does not produce unpermissible forces and temperatures. It is recommended for a coating width of 5 mm, to provide such a distribution that the wider coating zone of 3 mm is provided for the fine grain part and a narrower coating zone of 2 mm is provided for the coarse grain part.

In the deep grinding in accordance with so-called quick-point process in which the axes between the grinding wheel and the workpiece are arranged in an inclined relation relative to one another, only an approximately point-shaped contact between grinding wheel and the workpiece is desired. The effective grinding wheel width must be selected as small as possible. Only then the object of the process to operate with very high material removal outputs can be achieved. As a result of this, a high loading of a small zone in the outer edge region of the grinding coating occurs. For preventing excessively high wear of the coating because of the high load, maximum coarse grinding grains in combination with a wear-resistant binder are to be selected. Only then the required true measurement on the workpiece can be obtained, since otherwise the wear of the grinding wheel causes shape deviations, especially cylindrical shape deviations in the workpiece.

On the other hand, by the selection of such a grinding coating, an excessively high roughness of the surface of the workpiece is produced. This is however not permissible for grinding. Thus the known constructions of the grinding wheels for this grinding process are not suitable for reaching the required surface roughness, or are characterized by excessively high wear or must be trued during the service life of the grinding wheels.

SUMMARY OF THE INVENTION

Accordingly, it is an object of the present invention to provide a grinding wheel with a small engagement width for deep grinding, which is provided in the outer region of the end surface with very high diamond fraction as protection against wear or rounding of this outer edge, and simultaneously provides a high quality of the surface of the workpiece.

In keeping with these objects and with others which will become apparent hereinafter, one feature of the present invention resides, briefly stated, in a grinding wheel in which the grinding coating at its side which is a forward side as considered in a feeding direction has a coating of diamond grains with a grain size of between 150 and 400 micrometer, and in a peripheral grinding wheel it is formed as a one-layer coating in direction of an axis of rotation of the grinding wheel and as a multilayer in a direction perpendicular to the axis of rotation of the grinding wheel, while diamond grains contact one another and held in a galvanically deposited nickel binding, and in the event of a cup grinding wheel the one-layer structure of the diamond coating is parallel to the axis of rotation of the cup grinding wheel.

In accordance with the present invention, the grinding coating zone with coarse diamonds and a wear-resistant binder is arranged around 2–3 mm wide zone with fine grain grinding medium. This grinding coating part has the object of reducing the roughness of the workpiece surface. The thus formed grinding wheel provides for high material removal output. The grinding coating zone which is decisive for high material removal and has coarse diamonds comes in engagement only with small effective width and thereby results in such method in which a subsequent part of the grinding coating zone only reduces the roughness produced on the workpiece surface without affecting the method principle of the small engagement for obtaining high output.

The inventive grinding wheel has the advantage that from the beginning of its use to a complete wear, the loading in the outermost loaded edge region of the end side is taken up by an extremely high diamond fraction, so that no roof formation or inclinations or roundings should be taken in consideration at this edge. In the event of high load such as for example occurring during a deep grinding in accordance with the quick-point process, the wear on the end outer side of the grinding wheel is not greater than on the peripheral surface which is subjected to a lower load and is less resistant. Thereby the original profile is maintained after longer use and wear of the grinding wheel. Due to the direct contact of the relatively great size diamond grains in the outer edge region, not only a high strength of the tool is achieved, but also because of the low active grinding wheel width, a high material removal output at optimal grinding properties is insured.

Several possibilities can be provided for applying and holding the inventive coating with diamonds of low grain size on the peripheral surface of the grinding wheel, which are held in the binder. Generally it is advisable when a diamond at the end surface with their binding which can be for example galvanically deposited and composed of nickel, are arranged on an intermediate layer which is connected with the binder of the fine diamond body on the peripheral surface. When the binder for the fine diamond grains is composed for example of bronze, the adherence of the galvanically deposited nickel to this binder is improved when an intermediate layer is provided and composed for example of sintered iron. Generally, it is advantageous when the intermediate layer is composed of such a metal which is a component of the binder of the fine grinding grains of the grinding coating on the peripheral surface. When this binder is composed for example of a phenol resin with a copper powder, the intermediate layer is composed for example of a powder-metallurgical copper layer. It suffices that the intermediate layer has a thickness of 0.1–0.3 mm. This can be achieved in a sintering process in a mold, in which simultaneously the intermediate layer and the binder with fine-grained small diamonds is sintered.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing the position of a grinding wheel relative to a workpiece during a deep grinding in accordance with the quick-point process;

FIG. 2 is a side view of a workpiece with a grinding wheel in use;

FIG. 3 is a view showing an edge region of a known grinding wheel;

FIG. 4 is a view showing a cup grinding wheel in accordance with the present invention, in section; and FIG. 5 is an edge region of an inventive peripheral grinding wheel with an intermediate layer.

DESCRIPTION OF THE PREFERRED EMBODIMENTS

An arrangement shown in FIG. 1 has a grinding wheel 2 in its position relative to a workpiece 1 during grinding in accordance with a quick-point process. In this process an approximately point-like contact between both parts takes place, and thereby a very high loading of the grinding wheel 2 occurs. As can be seen from the side view shown at the left, the axis of the grinding wheel 2 is inclined at an angle $\beta$ relative to the axis of the workpiece 1. As can be seen from the plan view shown at the right side, the axis of the grinding wheel 2 is inclined at an angle $\alpha$ relative to the axis of the workpiece 1 and thereby not only an inclined position in the plane of the drawing is provided, but also a spatial angle is provided.

The feeding of the grinding wheel 2 is performed in direction of the arrow 3, while the arrow 3' represents the adjusting direction of the grinding wheel. During such a working, the outwardly located end side region of the grinding wheel is especially loaded. This end side region is identified in FIG. 2 with reference numeral 6. The feeding of the grinding wheel 2 is again identified here with the arrow 3. During such a deep grinding, the surface quality of the workpiece 1 is produced by the peripheral surface 4, while the end surface 6 acts for a material removal.

For taking into consideration these different loadings, the known grinding wheel 2 shown in FIG. 2 is provided with a grinding coating composed of two different parts. The part 6 of the grinding coating has diamond grains of a greater size than those of the part 5. In this known arrangement the diamonds on the end side are however retained in a binder in a loose distribution and at a distance relative to one another. The binder is composed of the same material as the binder of the grinding coating part 5 of the peripheral surface 4. As a result, during a strong loading a "roof profile" 7 or an inclination at the outer edge of the grinding wheel must be taken into consideration. It leads to a reduction of the material removal output and increase in the grinding forces of the workpiece.

When the grinding wheel is formed in accordance with the present invention as shown in FIGS. 4 and 5, the above mentioned disadvantages are eliminated. In the grinding wheel shown in these Figures, the end side or the peripheral side of the grinding wheel has a grinding coating which is composed of a single coating from diamond grains 9' of great size. It is formed as a one-layer coating in direction parallel to the axis of rotation of the grinding wheel and as a multi-layer coating in direction perpendicular to the axis of rotation of the grinding wheel for the peripheral grinding wheel shown in FIG. 5, and in a reverse order for the cup shaped grinding wheel shown in FIG. 4.

In the latter case, the part of the coating with the grains of great size is provided on the peripheral surface of the grinding wheel and the grinding coating part identified with reference 4 forms the end surface of the grinding wheel. In both cases, the feeding direction extends parallel to the grinding edge of the workpiece and in FIG. 4 is from the left to the right.

The individual grinding grains 9' which have the size of between 150 and 400 micrometer and retained in a galvanically deposited nickel binder 10. This provides such an arrangement of diamond grains 9' relative to one another that they are in direct contact with one another.

The binder for fine grain diamonds in the peripheral surface 4 can be composed of such a material as a phenol resin with nickel powder to provide a sufficient adherence to the galvanically deposited nickel for holding the diamonds 9'. In contrast, in the embodiment shown in FIG. 5 the intermediate layer 8 is provided for an improved adherence. The intermediate layer 8 is applied by means of powder metallurgy in a sintering process and composed for example of metal which is a component of the binder of the grinding coating 5. When such a binding is composed for example of a resin and a copper powder or steel powder, the intermediate layer 8 is also composed of copper or steel.

The above mentioned galvanically applied nickel binding is not the only solution to form a one-layer grinding coating. Also, thin sintered bindings can be used as well. For example, a thin layer of bronze with diamonds of course size grains can be uniformly distributed over a surface of a mold, compressed in some cases in cold condition, and then dispersed over a layer with 3 mm thickness. Such a layer can be composed of another bronze plus fine grain diamonds in a substantially lower concentration. Both layers then can be finely sintered. The same process is recommended for synthetic resin binder or also with different binders for coarse-grain and the fine-grain zone of the grinding coating. There are many possibilities as long as the galvanic deposition as binder is a capricious solution.

The diamonds or diamond grains referred to hereinabove can be natural or synthetic diamonds, such as for example grains of cubic crystalline boron nitride which in their action are identical to the diamond grains.

It will be understood that each of the elements described above, or two or more together, may also find a useful application in other types of constructions differing from the types described above.

While the invention has been illustrated and described as embodied in a grinding wheel for deep dringing, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A rotatable grinding wheel having a center axis of rotation and a front face for engaging a workpiece when the grinding wheel is moved in a feeding direction relative to the workpiece during a deep grinding operation, comprising a first diamond coating secured to said front face and including a plurality of fine grain diamonds; a second diamond coating secured to a free end face of said first diamond coating and including a plurality of diamonds of a relatively large size, said second diamond coating being arranged forwardly of said first diamond coating in the feeding direction, said large size diamonds being arranged in a single layer in the feeding direction in direct contact with one another and held in a galvanically deposited binder; and a powder-metallurgy produced intermediate layer which is arranged between said coatings, said second coating being arranged on said intermediate layer.

2. A grinding wheel as defined in claim 1, wherein the grinding wheel is a peripheral grinding wheel.

3. A grinding wheel as defined in claim 1, wherein the grinding wheel is a cup-shaped grinding wheel.

4. A grinding wheel as defined in claim 1, wherein said diamond grains of said second coating part have a grain size of between 150 and 400 micrometers.

5. A grinding wheel as defined in claim 1, wherein said intermediate layer is composed of sintered iron.

6. A grinding wheel as defined in claim 1, wherein said first coating has a binder composed of a predetermined metal and holding said fine grained diamonds, said intermediate layer being composed of the same metal as said binder of said first coating.

7. A grinding wheel as defined in claim 1, wherein said intermediate layer is composed of nickel.

8. A grinding wheel as defined in claim 1, wherein said intermediate layer has a thickness of between 0.1 and 0.3 mm.

9. A grinding wheel as defined in claim 1, wherein said large size diamonds in said single layer form patterns which are concentric with respect to said center axis.

10. A grinding wheel as defined in claim 9, wherein said fine grain diamonds of the first coating are held in a binder which differs from said galvanically deposited binder of the second coating.

11. A grinding wheel as defined in claim 10, wherein a binder of said first coating is formed of a material providing an adherence to said binder of said second coating.

* * * * *